US011307009B2

(12) United States Patent
Scott et al.

(10) Patent No.: US 11,307,009 B2
(45) Date of Patent: Apr. 19, 2022

(54) METHOD AND APPARATUS FOR DETERMINING PROJECTILE FIN DEPLOYMENT TIMELINE

(71) Applicant: Raytheon Company, Waltham, MA (US)

(72) Inventors: Mark A. Scott, Vail, AZ (US); Douglas J. Eliason, St. David, AZ (US)

(73) Assignee: Raytheon Company, Waltham, MA (US)

( * ) Notice: Subject to any disclaimer, the term of this patent is extended or adjusted under 35 U.S.C. 154(b) by 347 days.

(21) Appl. No.: 16/674,442

(22) Filed: Nov. 5, 2019

(65) Prior Publication Data

US 2021/0131776 A1 May 6, 2021

(51) Int. Cl.
*F42B 10/14* (2006.01)
*F42B 30/00* (2006.01)

(52) U.S. Cl.
CPC ..... *F42B 30/006* (2013.01); *F42B 10/14* (2013.01)

(58) Field of Classification Search
CPC ..... F42B 10/06; F42B 10/12; F42B 10/14; F42B 30/006
See application file for complete search history.

(56) References Cited

U.S. PATENT DOCUMENTS 4,570,118 A 2/1986 Tomeczak
5,159,268 A 10/1992 Wu
5,593,109 A * 1/1997 Williams ..... G05D 17/02 244/3.21
6,322,404 B1 11/2001 Magee et al.
10,735,654 B1 * 8/2020 Jankowski ..... F42B 10/06
11,150,062 B1 * 10/2021 Jankowski ..... F42B 10/14
2008/0111020 A1 * 5/2008 Peterson ..... F42B 10/14 244/3.28
2009/0126523 A1 * 5/2009 Fjerstad ..... F42B 10/64 74/422
2009/0127378 A1 * 5/2009 Turner ..... F42B 10/14 244/3.27
2012/0175458 A1 * 7/2012 Geswender ..... F42B 10/06 244/3.24
2012/0175459 A1 * 7/2012 Geswender ..... F42B 10/26 244/3.24
2021/0285747 A1 * 9/2021 Willits ..... F42B 30/006

* cited by examiner

*Primary Examiner* — Benjamin P Lee
(74) *Attorney, Agent, or Firm* — Daly, Crowley, Mofford & Durkee, LLP

(57) ABSTRACT

A projectile is disclosed, comprising: a body; a fin having a magnet disposed thereon, the fin being coupled to the body, at least a portion of the fin being arranged to: (i) stay inside the body before the projectile is launched, and (ii) exit the body after the projectile is launched; a magnetic sensor disposed within the body, the magnetic sensor being arranged to detect changes in a position of the magnet relative to the magnetic sensor while the fin is exiting the body; and a data recorder disposed within the body, the data recorder being operatively coupled to the magnetic sensor, wherein the data recorder is configured to use the magnetic sensor to collect data indicating a displacement of the fin relative to the body after the projectile is launched.

20 Claims, 16 Drawing Sheets

METHOD AND APPARATUS FOR DETERMINING PROJECTILE FIN DEPLOYMENT TIMELINE

BACKGROUND

Fin-stabilized projectiles commonly include a projectile body and a fin assembly. The fin assembly of a fin-stabilized projectile may include a plurality of fins. The fins are initially retracted when the fin-stabilized projectile is loaded into a cannon, and subsequently deploy after the projectile is launched. Fin-stabilized projectiles are mechanically more complex than conventional projectiles, but they may have higher firing ranges and greater firing accuracy.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to aspects of the disclosure, a projectile is provided, comprising: a body; a fin having a magnet disposed thereon, the fin being coupled to the body, at least a portion of the fin being arranged to: (i) stay inside the body before the projectile is launched, and (ii) exit the body after the projectile is launched; a magnetic sensor disposed within the body, the magnetic sensor being arranged to detect changes in a position of the magnet relative to the magnetic sensor while the fin is exiting the body; and a data recorder disposed within the body, the data recorder being operatively coupled to the magnetic sensor, wherein the data recorder is configured to use the magnetic sensor to collect data indicating a displacement of the fin relative to the body after the projectile is launched.

According to aspects of the disclosure, a projectile is provided, comprising: a body; a plurality of fins coupled to the body; a plurality of magnets, each of the magnets being disposed on a different respective one of the plurality of fins, wherein each of the magnets is disposed inside the body when the magnet's respective fin is in a stowed position, and each of the magnets the magnet is situated outside the body when the magnet's respective fin is in an extended position; a plurality of magnetic sensors disposed inside the body, each of the magnetic sensors being disposed adjacent to a different one of the plurality of fins; and a data recorder disposed inside the body, the data recorder being operatively coupled to each of the plurality of magnetic sensors, wherein the data recorder is configured to collect data indicating a respective displacement of each of the plurality of fins after the projectile is launched.

According to aspects of the disclosure, a method for analyzing an operation of a fin-stabilized projectile is provided, the method comprising: receiving a position data set that is collected by a data recorder disposed inside a fin-stabilized projectile, the data set indicating a position of a fin of the projectile at different time instants; receiving a pressure data set indicating a pressure experienced by the projectile at different time instants; identifying an event of interest based on the pressure data set; generating a deployment curve for the fin, the deployment curve identifying the position of the fin at different time instants during a launch of the fin-stabilized projectile.

BRIEF DESCRIPTION OF THE DRAWING FIGURES

Other aspects, features, and advantages of the claimed invention will become more fully apparent from the following detailed description, the appended claims, and the accompanying drawings in which like reference numerals identify similar or identical elements. Reference numerals that are introduced in the specification in association with a drawing figure may be repeated in one or more subsequent figures without additional description in the specification in order to provide context for other features.

DETAILED DESCRIPTION

Figure 1A:
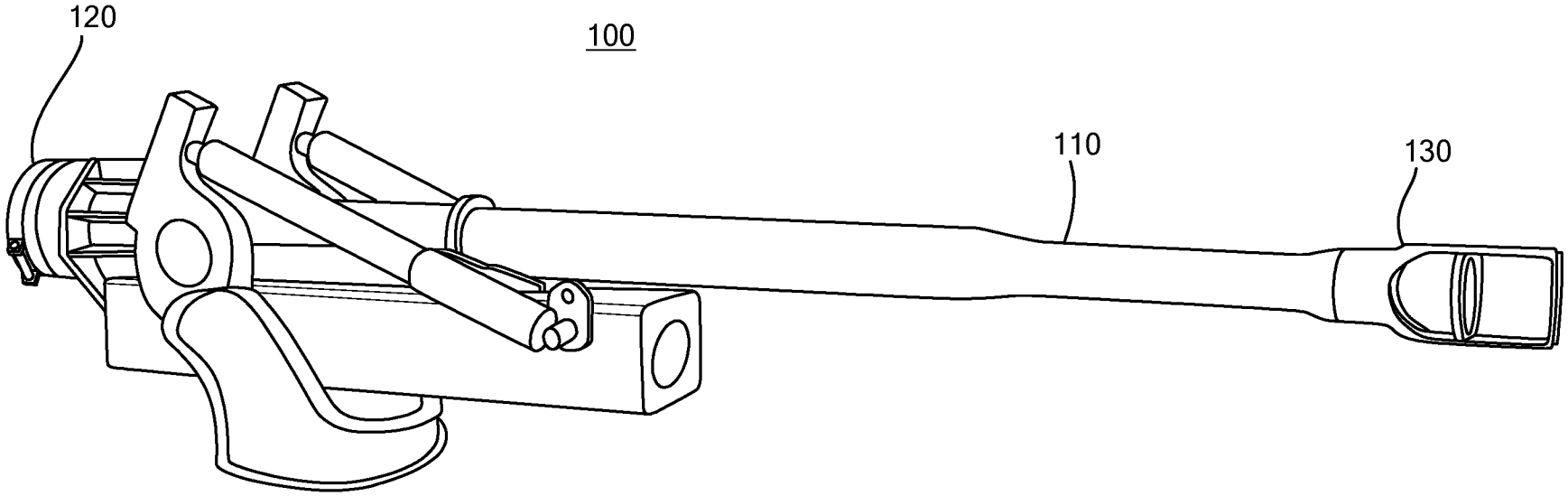
FIG. 1A is a diagram of an example of a cannon for use with a fin deployment monitoring projectile, according to aspects of the disclosure.
Figure 1B:
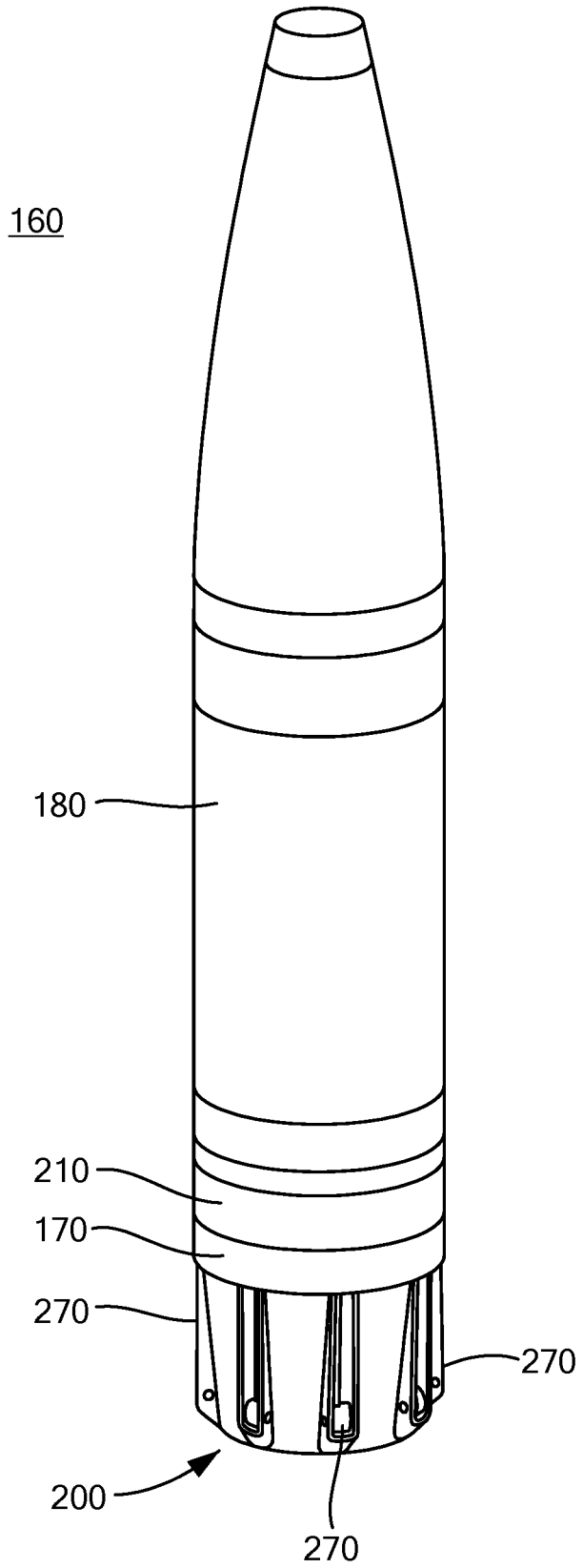
FIG. 1B is a diagram of an example of a fin-stabilized projectile with its fins stowed, according to aspects of the disclosure.
Figure 1C:
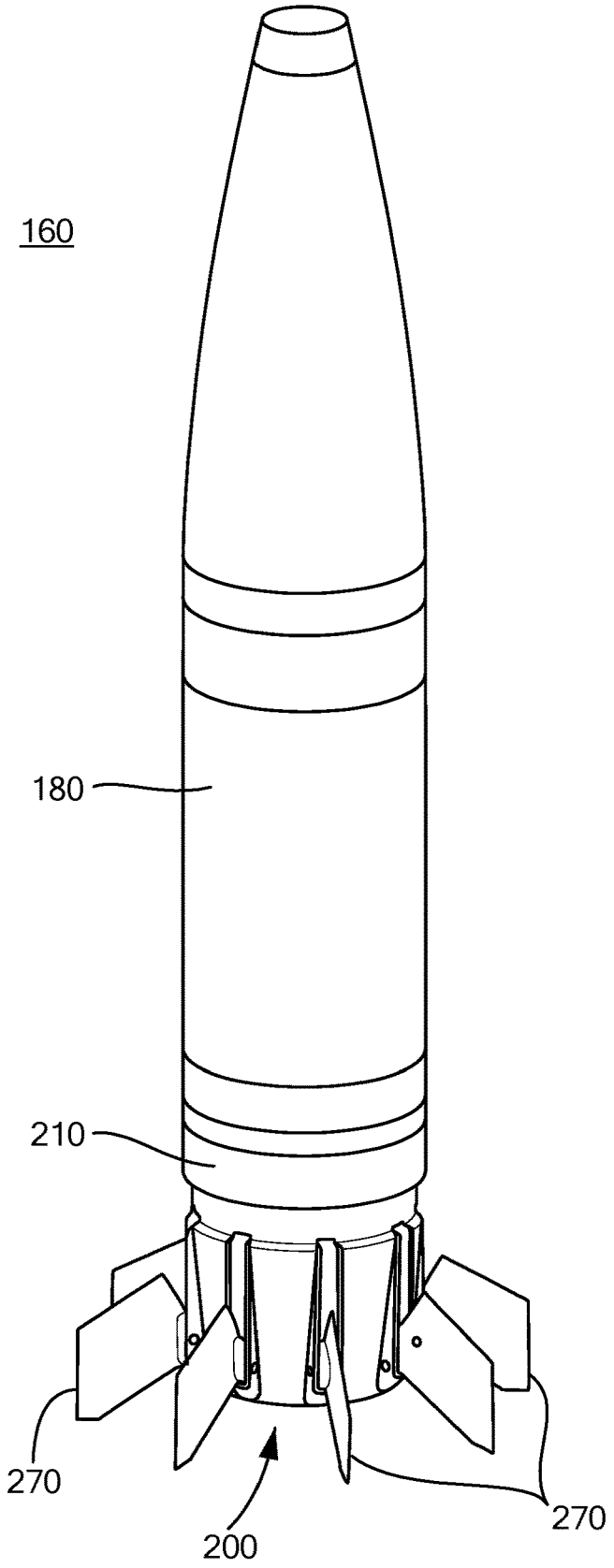
FIG. 1C is a diagram of an example of a fin-stabilized projectile with its fins deployed, according to aspects of the disclosure.
Figure 2A:
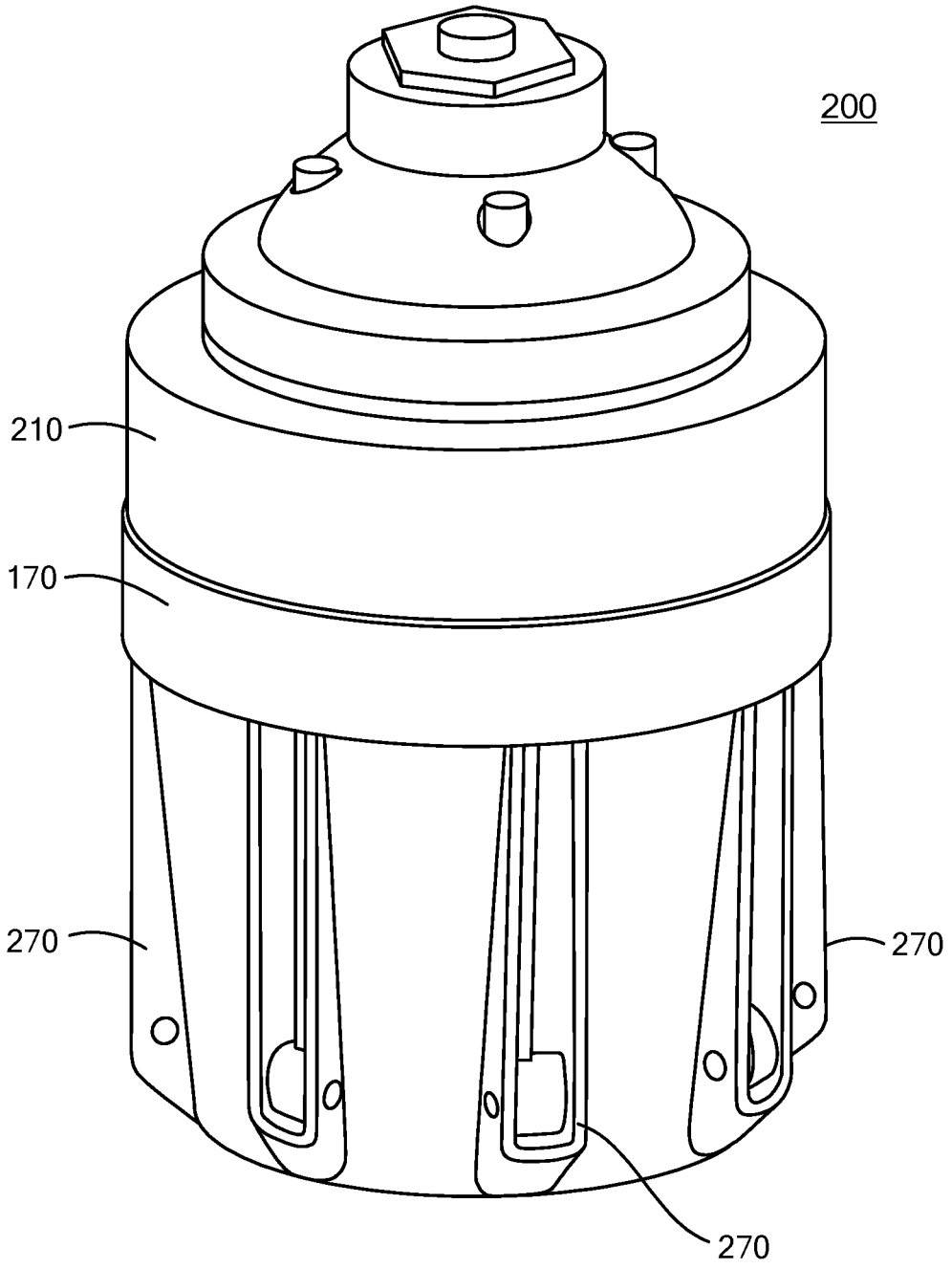
FIG. 2A is a diagram of a projectile base having its fins stowed, according to aspects of the disclosure.
Figure 2B:
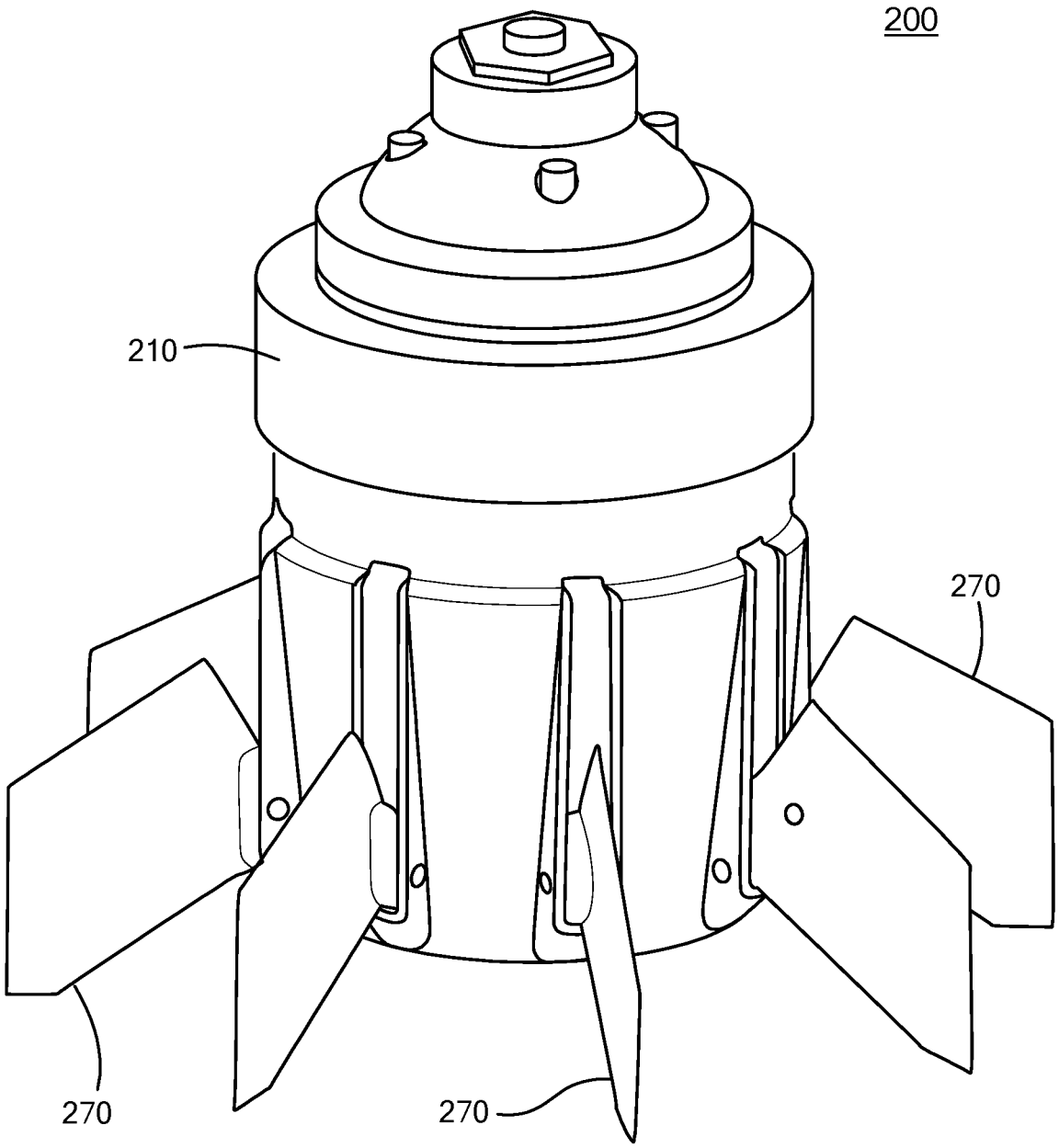
FIG. 2B is a diagram of the projectile base of FIG. 2A when the projectile's fins are deployed, according to aspects of the disclosure.
Figure 2C:
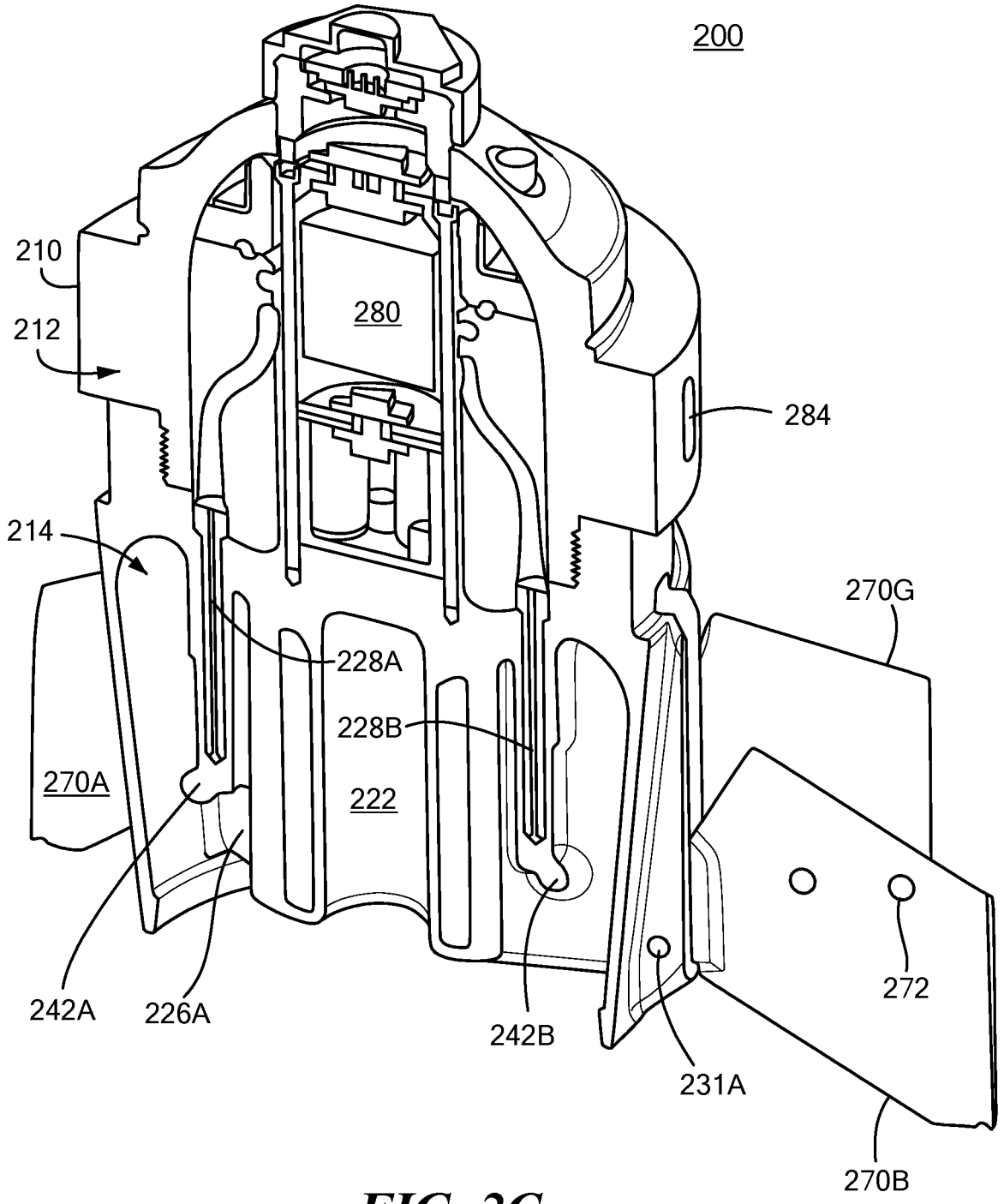
FIG. 2C is a perspective cross-sectional view of the projectile base of FIG. 2A, according to aspects of the disclosure.
Figure 2D:
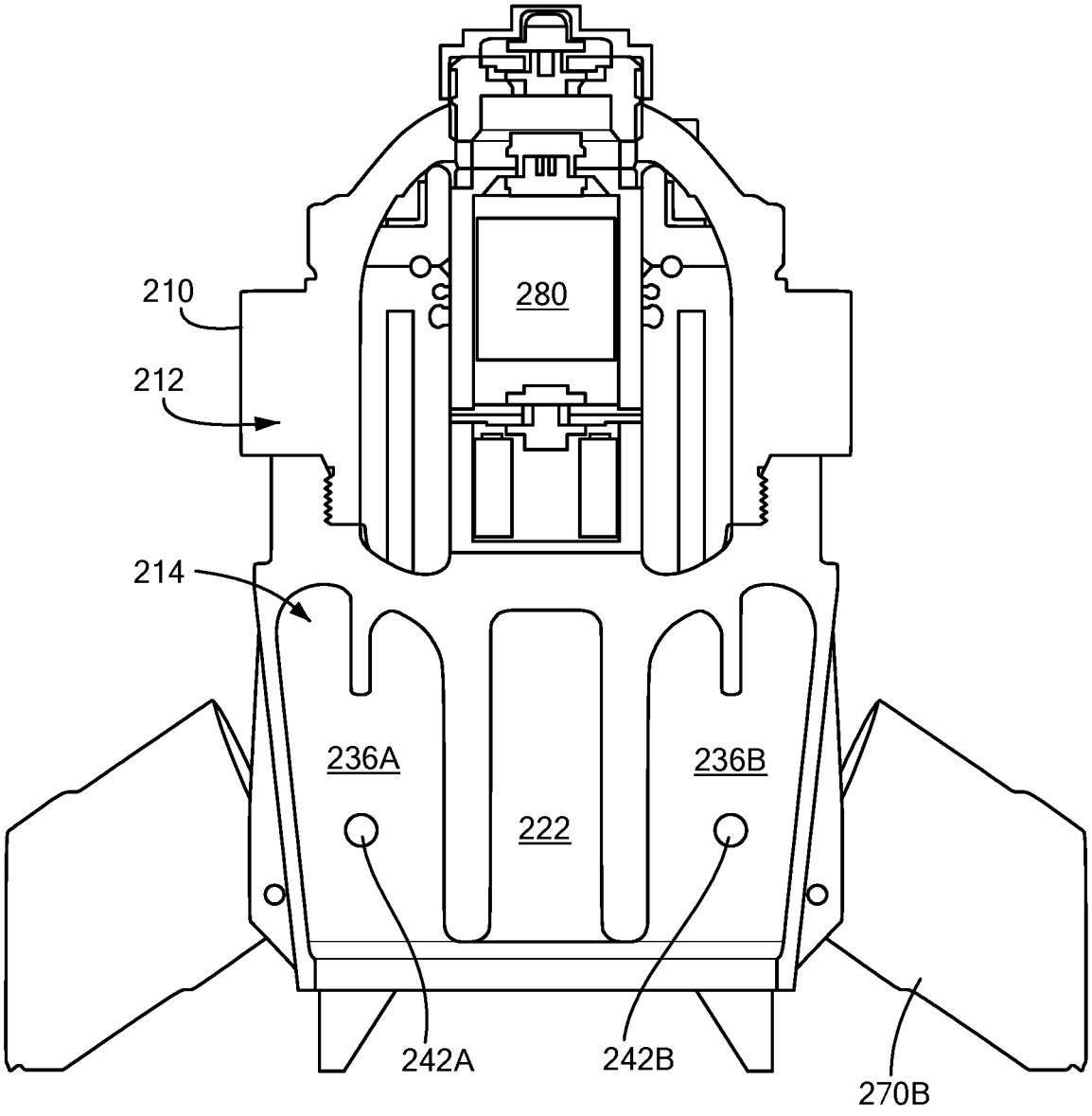
FIG. 2D is a planar cross-sectional view of the projectile base of FIG. 2A, according to aspects of the disclosure.
Figure 2E:
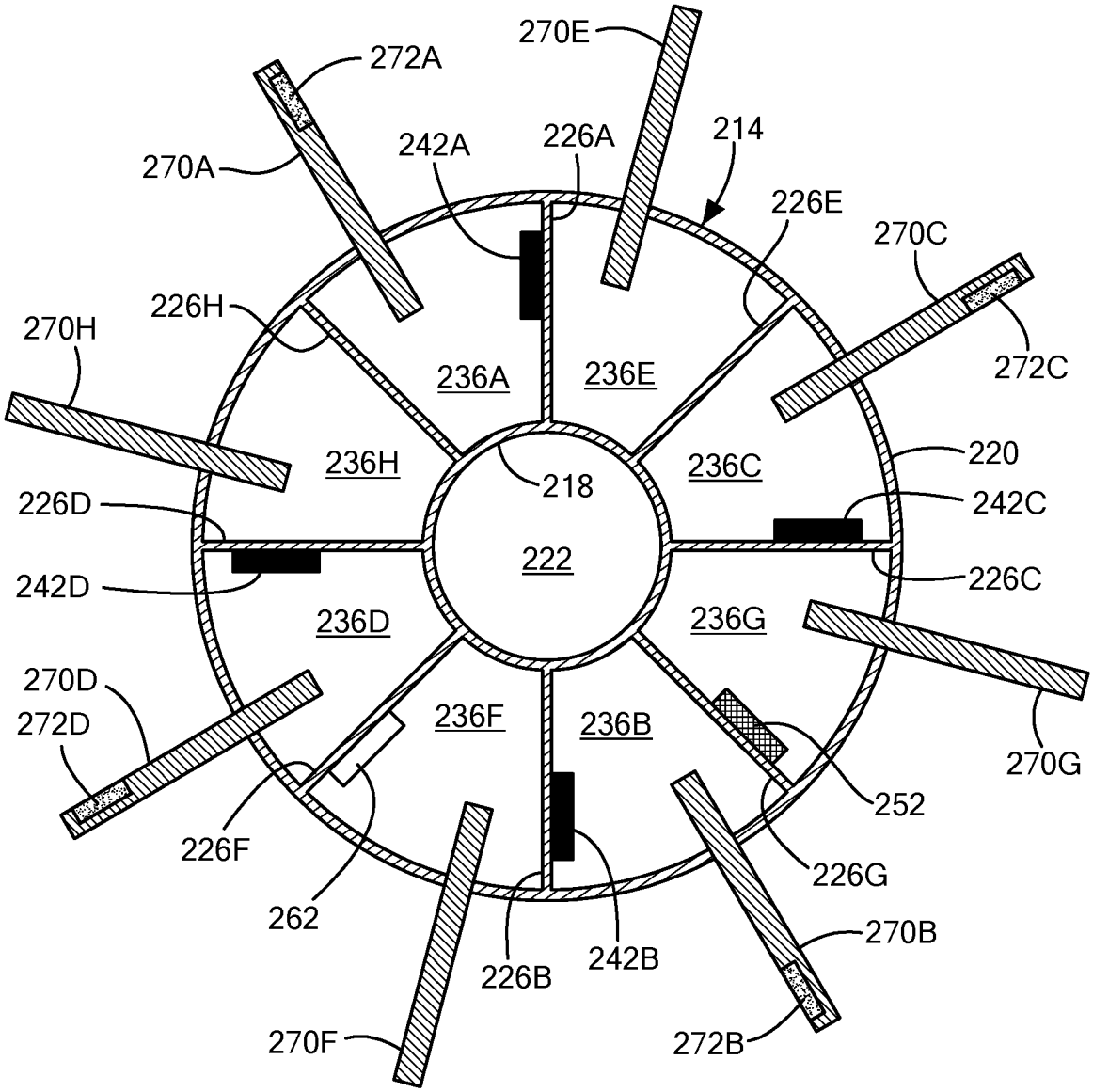
FIG. 2E is a planar cross-sectional view of the projectile base of FIG. 2A, according to aspects of the disclosure.

FIG. 1A is a diagram of a cannon 100 that can be used in combination with a fin deployment monitoring projectile, according to aspects of the disclosure. As illustrated, the cannon 100 may include a barrel 110 having a loading chamber 120 on one end, and a muzzle brake 130 on the other. In operation, the cannon 100 may be loaded by placing a fin-stabilized projectile 160 (shown in FIGS. 1B-C)_in the loading chamber 120. The fin-stabilized projectile 160 may include a main portion 180 that is coupled to a projectile base 200. The projectile base 200 may include a plurality of fins 270, as shown. The fin-stabilized projectile 160 may have its fins retracted into the projectile's body when loaded into the cannon, and it may have an obturating ring 170 (and/or a retention ring) placed over the fins 270. When the cannon 100 is fired, the obturating ring 170 may disengage from the projectile 160 when the projectile 160 reaches the muzzle brake 130, allowing the fins 270 to deploy. As is well known in the art, the fins 270 may provide the projectile 160 with additional stability, allowing the projectile 160 to reach its target with greater precision.

Fin deployment is critical with respect to control range and stability of the fin-stabilized projectile. The timeline for fin deployment is typically measured in milliseconds and occurs in harsh conditions that are normally obscured from the view of cameras (e.g., in the barrel 110). For this reason, when fin-stabilized projectiles are designed, the fin deployment timeline of the projectiles is normally evaluated using computer modeling. Such computer modeling, however, may be difficult to validate for accuracy and/or completeness.

FIGS. 2A-E show the projectile base 200 in further detail. As is discussed further below, the projectile base 200 can be used to monitor the fin deployment timeline of the fins 270 and evaluate existing computer models for the deployment of projectile fins. The projectile base 200 is provided with an onboard data recorder 280, which is disposed inside the body of the projectile base 200 and arranged to record data relating to the deployment of the fins of the projectile base 200. According to the present example, the projectile base 200 is launched by using the cannon 100 (FIG. 1). After the projectile 160 is launched, the projectile 160, along with the projectile base 200, is retrieved from the range. Next, the onboard data recorder 280 is connected to a workstation and the data collected by the onboard data recorder 280 is downloaded onto the workstation. The downloaded data is used to plot (or otherwise generate) the timeline of deployment of at least one of the fins of projectile base 200.

As illustrated in FIGS. 2A-E, the projectile base 200 may include a body 210 and a plurality of fins 270 coupled to the body 210 via respective mounting pins 231. The body 210 may have a first portion 212 and a second portion 214. The first portion 212 may include a cavity having the onboard data recorder 280 disposed therein. Furthermore, a data port 284 may be disposed on the first portion 212 of the body 210, as shown. The data port 284 may be operationally coupled to the onboard data recorder 280 and used to connect the data recorder to an external device. In some implementations, the data port 284 may be used to update the firmware of the onboard data recorder 280, load configuration settings on the onboard data recorder 280, and/or perform any other type of data transfer between the external device and the onboard data recorder 280. In some implementations, the data port 284 may be destroyed after the projectile 160 is launched. In such implementations, data that is collected by the onboard data recorder 280 may be downloaded by using another type of connection interface (e.g., a wireless interface).

The second portion 214 may include an inner sidewall 218 and an outer sidewall 220. The inner sidewall 218 may be arranged to define a cavity 222. Furthermore, the inner sidewall 218 and the outer sidewall 220 may be arranged to define a plurality of compartments 236. The plurality of compartments 236 may be separated from one another via interior walls 226. Each of the compartments 236 may be arranged to receive a different one of the fins 270 when the fins 270 are stowed. As illustrated, each of the fins 270 may be coupled to the second portion 214 of the body 210 via a respective mounting pin 231. When any of the fins 270 is deployed, the fin may 270 rotate, about its respective mounting pin 231, out of the fin's respective compartment 236, and into the open. Although in the example of FIGS. 2A-E the fins 270 are coupled to the body 210 via mounting pins, and are configured to rotate out of the body 210, it will be understood that the present disclosure is not limited to any specific method or mechanism for mounting and/or deploying the fins 270 of the projectile base 200.

A plurality of magnetic sensors 242 may be disposed inside the compartments 236. According to the present example, a respective magnetic sensor 242*a* may be mounted on interior wall 226*a* of compartment 236*a*; a magnetic sensor 242*b* may be mounted on interior wall 226*b* of compartment 236*b*; a magnetic sensor 242*c* may be mounted on interior wall 226*c* of compartment 236*c*; and a magnetic sensor 242*d* may be mounted on interior wall 226*d* of compartment 236*d*. According to the present example, each of the magnetic sensors 242 may be operatively coupled to the onboard data recorder 280 via a data line that is routed along the interior wall 226 on which the magnetic sensor 242 is mounted. For instance, magnetic sensor 242*a* may be coupled to the onboard data recorder 280 via a line 228*a* that is routed along interior wall 226*a*. Similarly, the magnetic sensor 242*b* may be coupled to the onboard data recorder 280 via a line 228*b* that extends along interior wall 226*b*. According to the present example, each of the magnetic sensors 242 is a Hall effect sensor. However, it will be understood that alternative implementations are possible in which other types of sensors are used, such as a giant magnetoresistance (GMR) sensor or a tunnel magnetoresistance (TMR) sensor for example.

The projectile base 200 may further include a pressure sensor 252 and/or an accelerometer 262. The pressure sensor 252 may be mounted on the wall 226*g* of the compartment 236, and the accelerometer 262 may be mounted on the wall 226*f* of the compartment 236*f*. The pressure sensor 252 may be operatively coupled to the onboard data recorder 280 via wiring (not shown) that routed along the wall 226*g*. The accelerometer 262 may be operatively coupled to the onboard data recorder 280 via wiring (not shown) that routed along the wall 22*f*. Although in the present example only one pressure sensor 252 is mounted in the projectile base 200, alternative implementations are possible in which multiple pressure sensors 252 are mounted on the projectile base 200. Although in the present example only one accelerometer 262 is mounted in the projectile base 200, alternative implementations are possible in which multiple accelerometers 262 are mounted on the device 228. Stated succinctly, the present disclosure is not limited to any specific number of pressure sensors and/or accelerometers being present in the projectile base 200.

When in the stowed position, each of the fins 270 may be disposed in a different one of the compartments 236. For example, fin 270*a* may be disposed in compartment 236*a*; fin 270*b* may be disposed in compartment 236*b*; fin 270*c* may be disposed in compartment 236*c*; fin 270*d* may be disposed in compartment 236*d*; fin 270*e* may be disposed in compartment 236*e*; fin 270*f* may be disposed in compartment 236*f*; fin 270*f* may be disposed in compartment 236*f*; and fin 270. The fins 270*a-d* may be provided with magnets 272A-D, respectively. Specifically, magnet 272*a* may be mounted on fin 270*a*; magnet 272*b* may be mounted on fin 270*b*; magnet 272*c* may be mounted on fin 270*c*; and magnet 272*d* may be mounted on fin 270*d*. Although in the present example, each of the fins 270*a-d* is provided with only one magnet, alternative implementations are possible in which multiple magnets are disposed on any of the fins 270*a-d*.

The magnetic sensor 242*a* may be arranged to detect the magnetic field that is produced by magnet 272*a*. As is further discussed below, the magnetic sensor 242*a* may be used to track the position of the fin 270*a*, as it rotates out of the body 210 when the projectile 160 is launched, in order to obtain a data record of the deployment of the fin 270*a*. The magnetic sensor 242*b* may be arranged to detect the magnetic field that is produced by magnet 272*b*. The magnetic sensor 242*b* may be used to track the position of the fin 270*b*, as it rotates out of the body 210, when the projectile 160 is launched, in order to obtain a data record of the deployment of the fin 270*b* The magnetic sensor 242*c* may be arranged to detect the magnetic field that is produced by magnet 272*c*. The magnetic sensor 242*c* may be used to track the position of the fin 270*c*, as it rotates out of the body 210, when the projectile 160 is launched, in order to obtain a data record of the deployment of the fin 270*c*. The magnetic sensor 242*d* may be arranged to detect the magnetic field that is produced by magnet 272*d*. The magnetic sensor 242*d* may be used to track the position of the fin 270*d*, as it rotates out of the body 210, when the projectile 160 is launched, in order to obtain a data record of the deployment of the fin 270*d*.

According to the example of FIGS. 2A-E, to permit each of the magnetic sensors 242 to effectively detect the magnetic field of only one magnet 272, no two magnetic sensors 242*a* are placed on the same wall 226 and/or in the same compartment 236. However, it will be understood that the present disclosure is not limited to any specific configuration of the magnets 272 and/or magnetic sensors 242. Although in the present example, the fins 270*a-d* are provided with one magnet each, alternative implementations are possible in which any of the fins 270*a-d* is provided with multiple magnets.

Figure 3A:
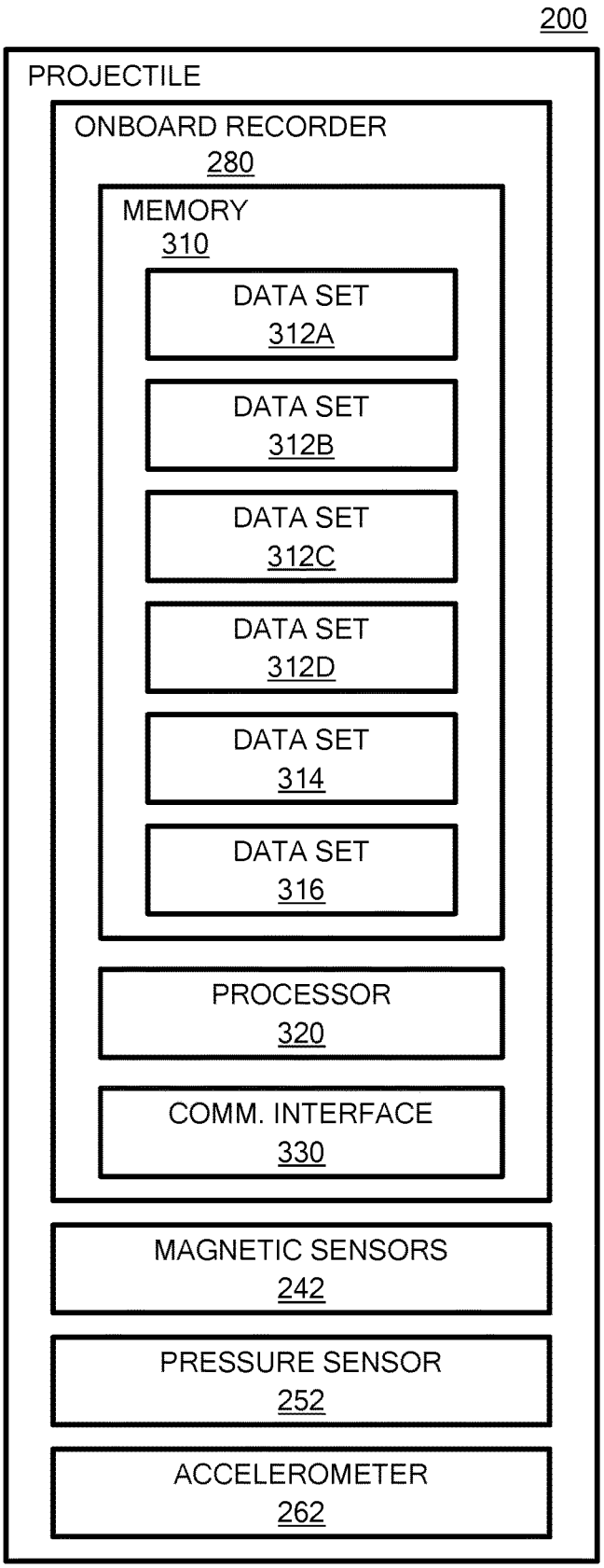
FIG. 3A is a block diagram of the projectile base of FIG. 2A, according to aspects of the disclosure.

FIG. 3A is a schematic diagram of the projectile base 200, according to aspects of the disclosure. As illustrated, the onboard data recorder 280 may include a memory 310, a processor 320, and communication interface(s) 330. The memory 310 may include any suitable type of volatile and/or non-volatile memory. For example, in some implementations, the memory 310 may include one or more of random access memory (RAM), a read-only memory (ROM), a solid-state drive (SSD), electrically erasable programmable read-only memory (EEPROM), and/or any other suitable type of memory. The processor 320 may include any suitable type of processing circuitry that is configured to receive data from any of the magnetic sensors 242, the pressure sensor 252, and the accelerometer 262. In some implementations, the processor may include one or more of an application-specific integrated circuit (ASIC), a field-programmable gate array (FPGA), and/or a general-purpose processor (e.g., an ARM-based processor, etc.). The communications interface(s) may include any suitable type of wired or wireless interface for transmitting or receiving data. In some implementations, the communications interface may include a Bluetooth interface, a WiFi interface, a ZigBee interface, and/or any other suitable type of interface. As another example, in some implementations, the communications interface may include a universal serial bus (USB) interface, an I2C interface, and/or any other suitable type of wired communications interface.

In operation, the onboard data recorder 280 may store in memory the data sets 312, 314, and 316. Data set 312*a* may include data that is generated by using magnetic sensor 242*a*; as such, data set 312*a* may indicate the movements and/or position of the fin 270*a* when the fin 270*a* is being deployed. Data set 312*b* may include data that is generated by using magnetic sensor 242*b*; as such, data set 312*b* may indicate the movements and/or position of the fin 270*b* when the fin 270*b* is being deployed. Data set 312*c* may include data that is generated by using magnetic sensor 242*c*; as such, data set 312*c* may indicate the movements and/or position of the fin 270*c* when the fin 270*c* is being deployed. And data set 312*d* may include data that is generated by using magnetic sensor 242*d*; as such, data set 312*d* may indicate the movements and/or position of the fin 270*d* when the fin 270*d* is being deployed.

Data set 314 may include data that is generated by using the pressure sensor 252, and it may identify the amount of pressure that is exerted on the projectile 160 when the projectile 160 is launched. In some implementations, the data set 314 may be used to measure various characteristics of the propellant that is used to launch the projectile 160 from the cannon 100. Additionally, or alternatively, in some implementations, the data set 314 may be used to identify the time at which the projectile 160 reaches the muzzle brake 130 of the cannon 100. Reaching the muzzle brake 130 would result in a drop of the pressure that is incident on the projectile 160, which would be reflected in the data set 314. The data set 316 may include data that is generated by using the accelerometer 262. In some implementations, the data set 316 may be used to track the position of the projectile 160 (e.g., position inside the barrel 110 and/or muzzle brake 130) after the projectile base 200 is launched.

Figure 3B:
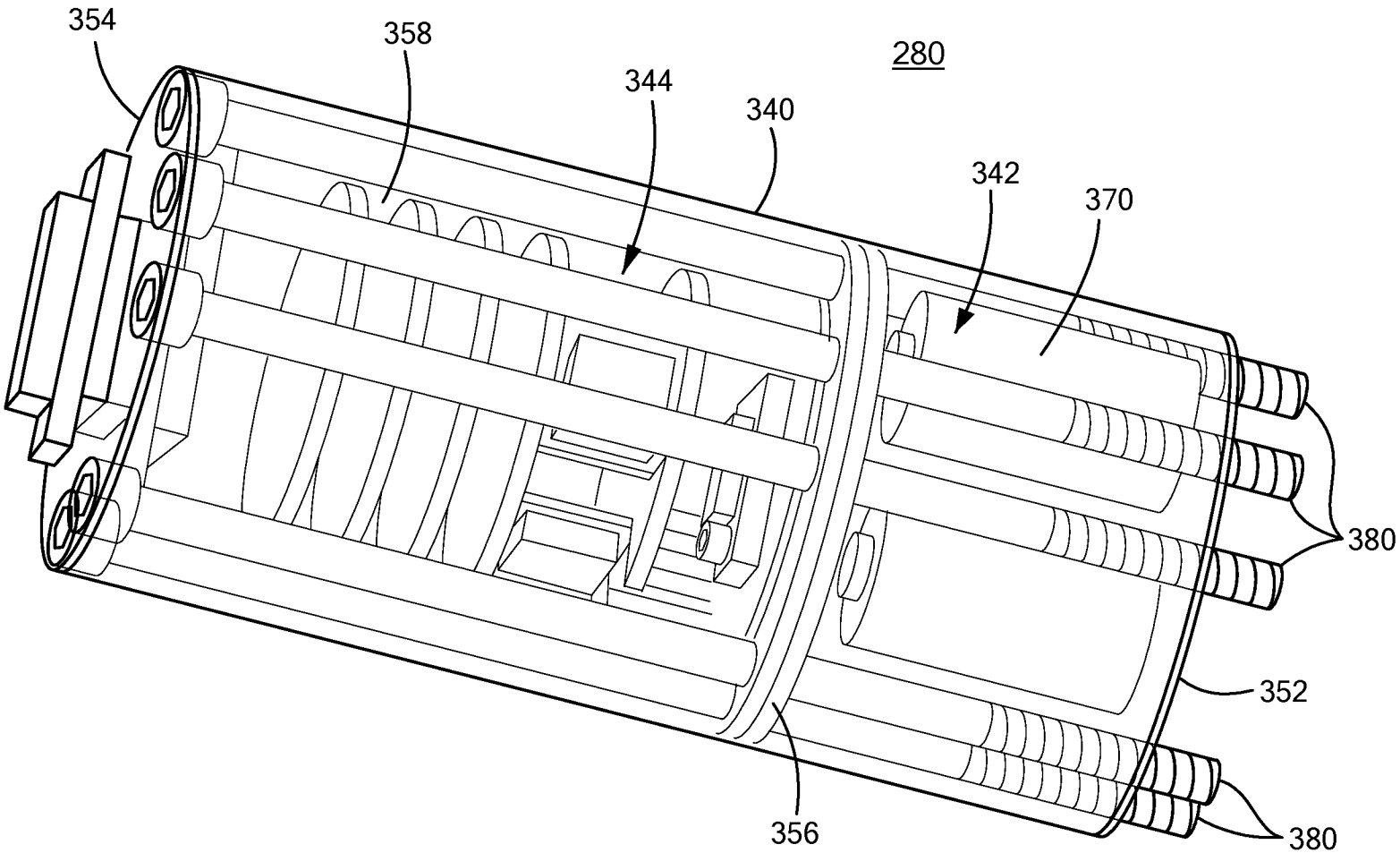
FIG. 3B is a perspective view of an on-board data recorder that is integrated into the projectile base of FIG. 2A, according to aspects of the disclosure.

FIG. 3B depicts the onboard data recorder 280 in further detail. As illustrated, the onboard data recorder 280 may have a reinforced enclosure 340. The enclosure 340 may be cylindrical in shape, and it may include a first portion 342 and a second portion 344, which are defined by a first cover 352, a separator wall 356, a second cover 354, and a sidewall 358. The first portion 342 of the enclosure 340 may contain the memory 310, the processor 320, the communications interface(s) 330, and/or any other electronic components of the onboard data recorder 280. The second portion 344 of the enclosure 340 may contain a plurality of batteries 370 and/or another type of power supply for the data recorder. The first portion 342 and/or the second portion 344 may be filled with encapsulating material, such as epoxy, in order to prevent the components of the onboard data recorder 280 from being damaged when the projectile 160 is fired.

The data recorder may further include a plurality of fasteners 380, which are disposed around the perimeter of the enclosure 340. The fasteners 380 are arranged to pull the first cover 352 and the second cover 354 towards one another to provide additional resistance to shear forces that are exerted on the onboard data recorder 280 (and/or projectile 160), when the projectile 160 exits the barrel of the cannon 100. Each of the fasteners 380 may extend through the first cover 352, the separator wall 356, and the second cover 354, as shown. According to the present example, fasteners 380 extend through the interior of the first portion 342 and the second portion 344, and they come in contact with the encapsulating material that is arranged to contain the internal components of the onboard data recorder 280. However, alternative implementations are possible in which the fasteners 380 are disposed outside of the first portion, and the second portion.

Figure 4:
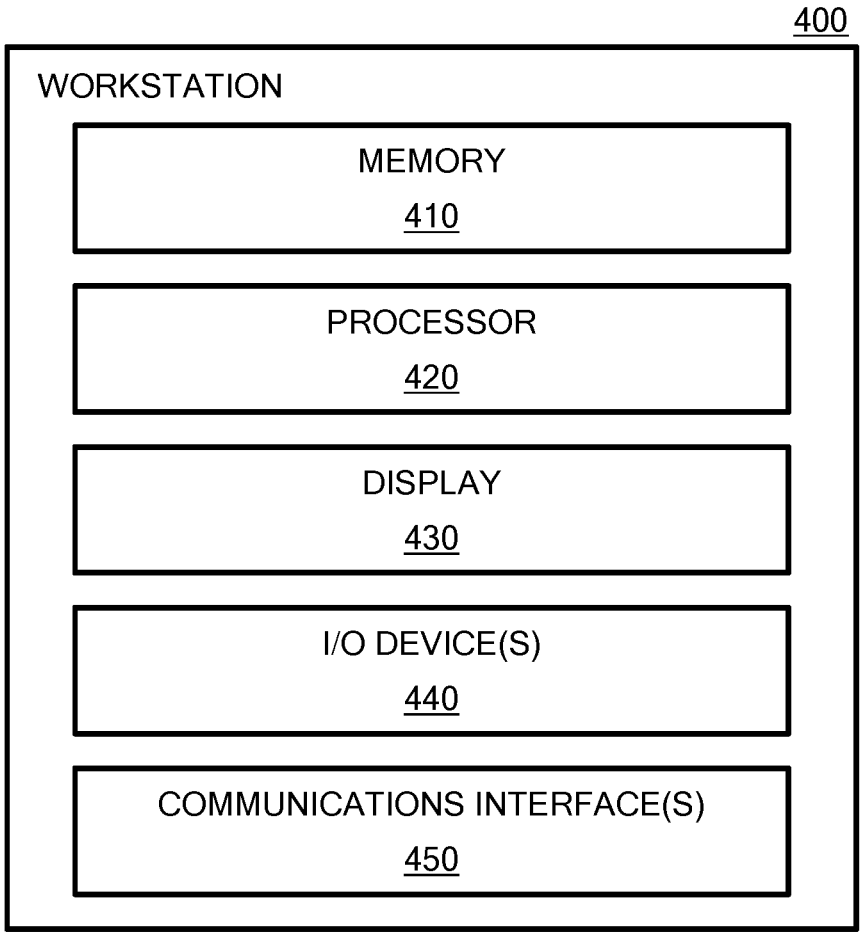
FIG. 4 is a block diagram of a workstation according to aspects of the disclosure.

FIG. 4 is a diagram of an example of a workstation 400 that is used in conjunction with the projectile base 200. The workstation 400 may be used to download and process data that is collected by the onboard data recorder 280. As illustrated, the workstation 400 may include a memory 410, a processor 420, a display 430, Input/Output (I/O) devices 440, and communications interface(s) 440. The memory 410 may include any suitable type of volatile or non-volatile memory. For example, in some implementations, the memory 410 may include one or more of random-access memory, a solid-state drive, an EEPROM device, etc. The processor 420 may include any suitable type of processing circuitry. For example, in some implementations, the processor 420, may include an application-specific integrated circuit (ASIC), a field-programmable gate array (FPGA), or a general-purpose processor (e.g., an ARM-based processor, an x86-processor, etc.). The display 430, may include any suitable type of display device, such as a liquid crystal display (LCD) screen. The I/O device(s) 440 may include any suitable type I/O device, such as a mouse, a keyboard, a speaker, a microphone, a camera, etc. The communications interface(s) 450 may include any suitable type of communications interface, such as one or more of an Ethernet interface, a Bluetooth interface, a WiFi interface, etc.

Figure 5:
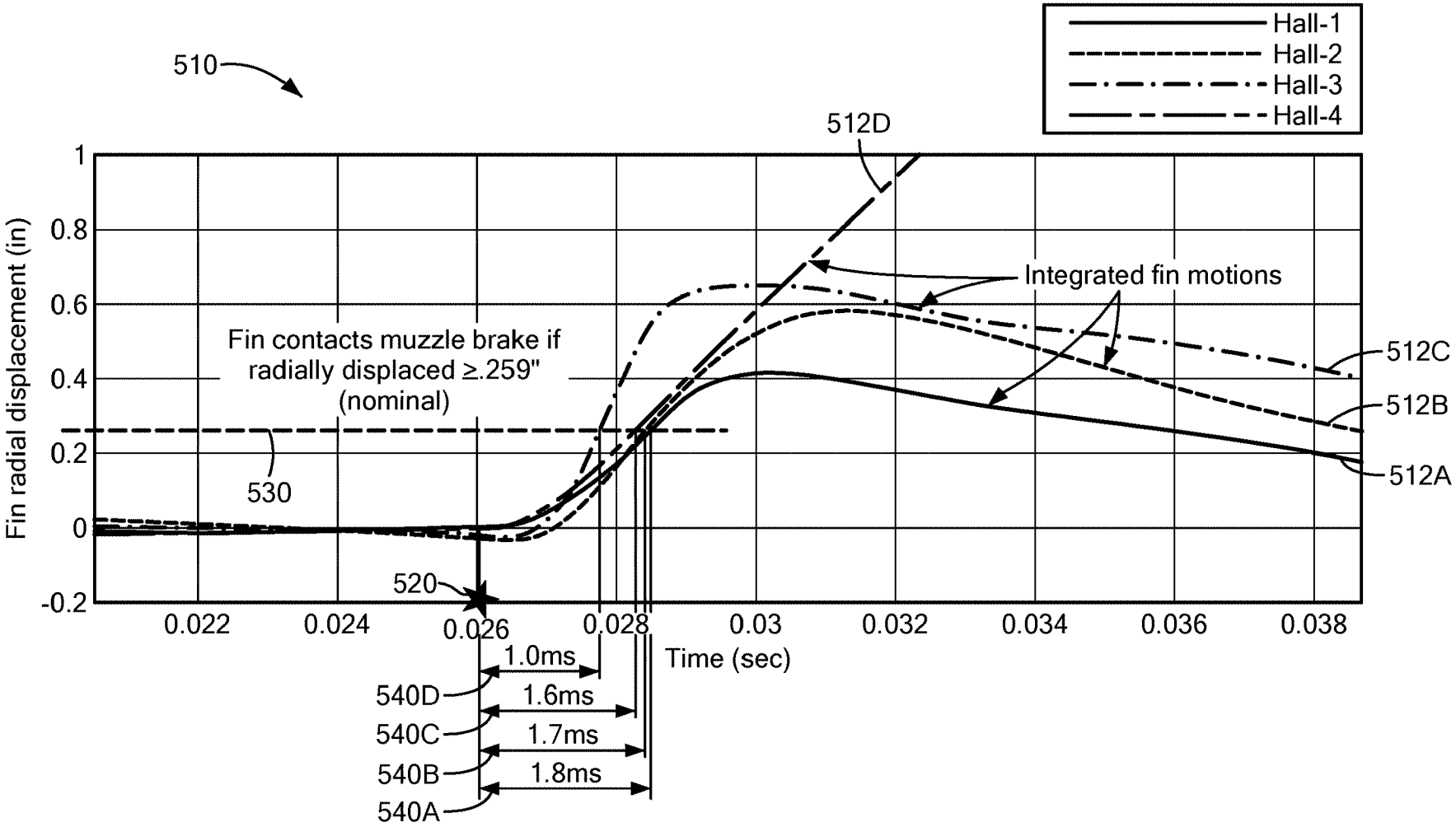
FIG. 5 is plot of fin deployment curves associated with the projectile base of FIG. 2A, according to aspects of the disclosure.

FIG. 5 depicts an example plot 510 of fin deployment data, according to aspects of the disclosure. The plot 510 may be generated by the workstation 400 based on one or more of the data sets 312, 314, and 316, which are collected by the onboard data recorder 280. The plot 510 may be part of a graphical user interface (GUI) of the workstation 400, and it can be displayed on display 430. The plot 510 may be used (as part of a design process) to evaluate the performance of fins 270 and/or any mechanisms that are used in the deployment of the fins 270.

The plot 510 may include deployment curves 512*a-d*, which indicate radial displacement (relative to the body 210, e.g., FIG. 2C) of each of the fins 270*a-d*, respectively. Specifically, the deployment curve 512*a* may be calculated based on the data set 312*a* (which is generated by the magnetic sensor 242*a*), and it may illustrate the radial displacement of the fin 270*a* relative to the body 210; the deployment curve 512*b* may be calculated based on the data set 312*b* (which is generated by the magnetic sensor 242*b*), and it may illustrate the radial displacement of the fin 270*b* relative to the body 210; the deployment curve 512*c* may be calculated based on the data set 312*c* (which is generated by the magnetic sensor 242*c*), and it may illustrate the radial displacement of the fin 270*c* relative to the body 210; and the deployment curve 512*d* may be calculated based on the data set 312*d* (which is generated by the magnetic sensor 242*d*), and it may illustrate the radial displacement of the fin 270*d* relative to the body 210. As used throughout the disclosure, the phrase "deployment curve of a fin" may refer to at least one of: (i) a set of values, wherein each of the values identifies the position of a projectile fin relative to the projectile body or (ii) a visual representation of the set of values. An example of a process for generating the fin deployment curves 512 is discussed further below with respect to FIG. 6.

In some implementations, the fin deployment curves 512 may be used by designers to observe the pattern in which any of the fins 270*a-d* opens. Furthermore, the fin deployment curves 512 may be used to detect whether any of the fins 270*a-d* fail to deploy or deploy at faster/slower pace than the other fins. As can be readily appreciated, the fin deployment curves 512 may be used to detect flaws in the design of the fins 270*a-d* before those flaws have made it into production, and they constitute a valuable tool which can be used by engineers in the design and development of fin-stabilized projectiles.

The plot 510 may further include a marker 520, which indicates the time when an event of interest has occurred. In some implementations, the event of interest may be the projectile 160 reaching the muzzle brake 130. In such implementations, the event of interest may be detected based on data that is produced by the pressure sensor 252. As noted above, a drop in the pressure that is measured by the pressure sensor 252 may indicate that the muzzle brake 130 has been reached by the projectile 160.

The fin deployment curve 512 may further include a marker 530 indicating a constraint on the operation of the projectile 160. According to the present example, marker 530 identifies the maximum radial displacement any of the fins 270 can have before coming in contact with the barrel 110 and/or muzzle brake 130. As can be readily appreciated, if any fins 270 deploys prematurely, and touches the barrel 110 and/or muzzle brake 130, that fin 270 can become damaged and may degrade barrel performance. In this regard, marker 530 can be used by designers to monitor whether any of the fins 270 deploys prematurely.

The plot 510 may further include a plurality of markers 540. Each of the markers 540 may indicate the duration of a different period of interest. Each period of interest may be associated with a different fin 270 of the projectile 160. Each period of interest may start when a particular event of interest has occurred, such as when the projectile 160 has reached the muzzle brake 130 or a predetermined location within the barrel 110 has been reached by the projectile 160. Each period of interest may end when a predetermined position (e.g., a predetermined radial displacement, etc.) has been reached by the period's respective fin. According to the present example, the marker 540 identifies a period of interest that is associated with the fin 270*a*; the marker 540*b* identifies a period of interest that is associated with the fin 270*b*; the marker 540*c* identifies a period of interest that is associated with the fin 270*c*; and the marker 540*d* identifies a period of interest that is associated with the fin 270*d*.

Figure 6:
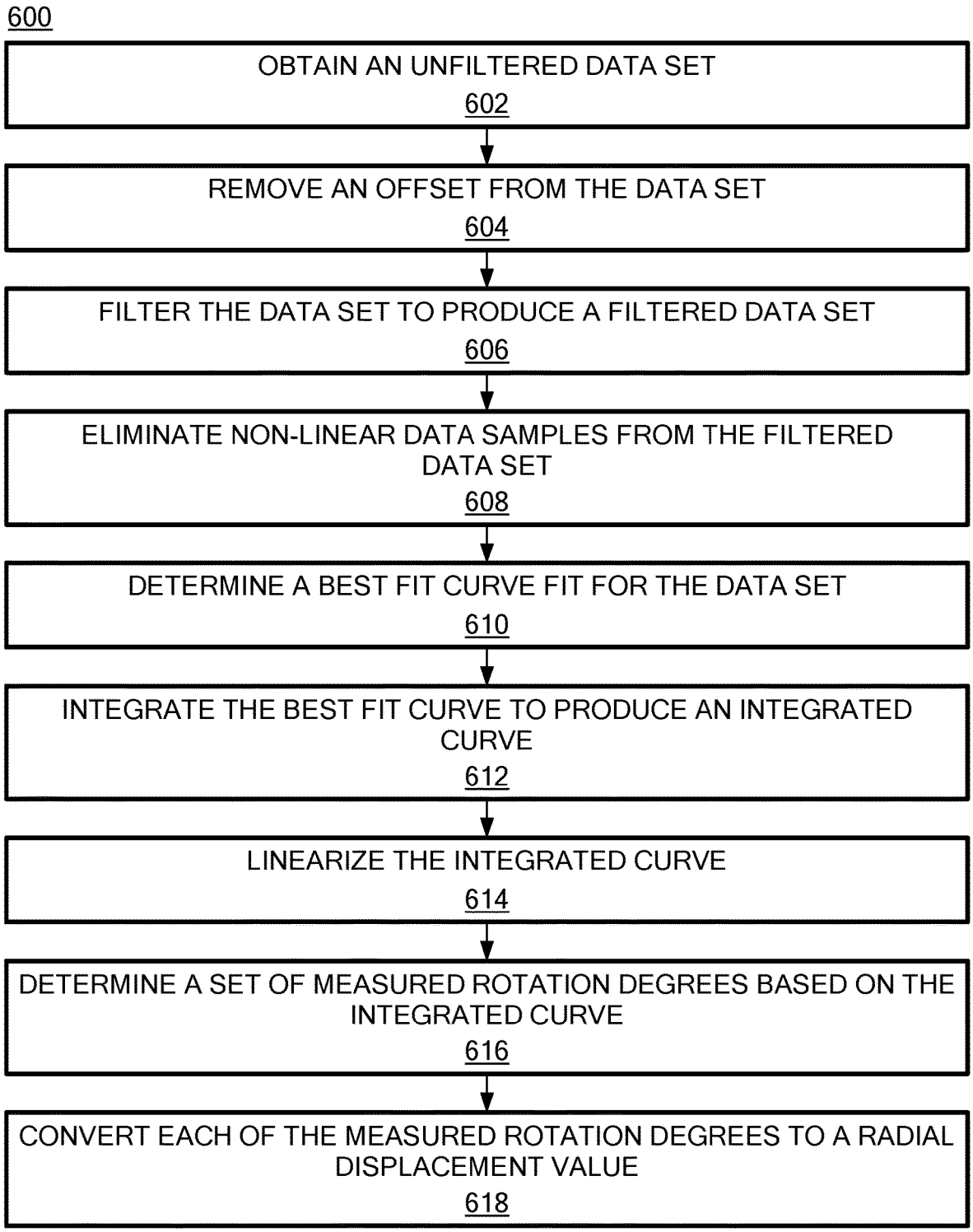
FIG. 6 is a flowchart of an example of a process, according to aspects of the disclosure.

FIG. 6 is a flowchart of an example of a process 600 for generating the fin deployment curves 512, according to aspects of the disclosure. Although the process 600 is described in the context of the deployment curve 512*a*, it will be understood that the process 600 can be used to generate any other deployment curve, such as any of the curves 512*b-c* for example. According to the example of FIG. 6, the process 600 is performed by the workstation 400. However, it will be understood that at least some of the steps in process 600 can be performed by the onboard data recorder 280 and/or any other suitable type of computing device. Stated succinctly, the present disclosure is not limited to any specific implementation of the process 600.

At step 602, the data set 310*a* is obtained from the onboard data recorder 280. Obtaining the data set 310*a* may include establishing a connection with the onboard data recorder and downloading the data set. The connection may include any suitable type of wireless connection, such as a Bluetooth connection. According to the present example, the data set 310*a* includes raw unfiltered data that is generated by the magnetic sensor 242*a* (and/or a corresponding analog-to-digital converter). As noted above, the data includes measurements of the magnetic field that is produced by the magnet 272*a*, which is mounted on the fin 270*a*. The value of each of the measurements is indicative of the rotational displacement of the fin 270*a* (e.g., relative to the body 210 of the projectile base 200).

Figure 8A:
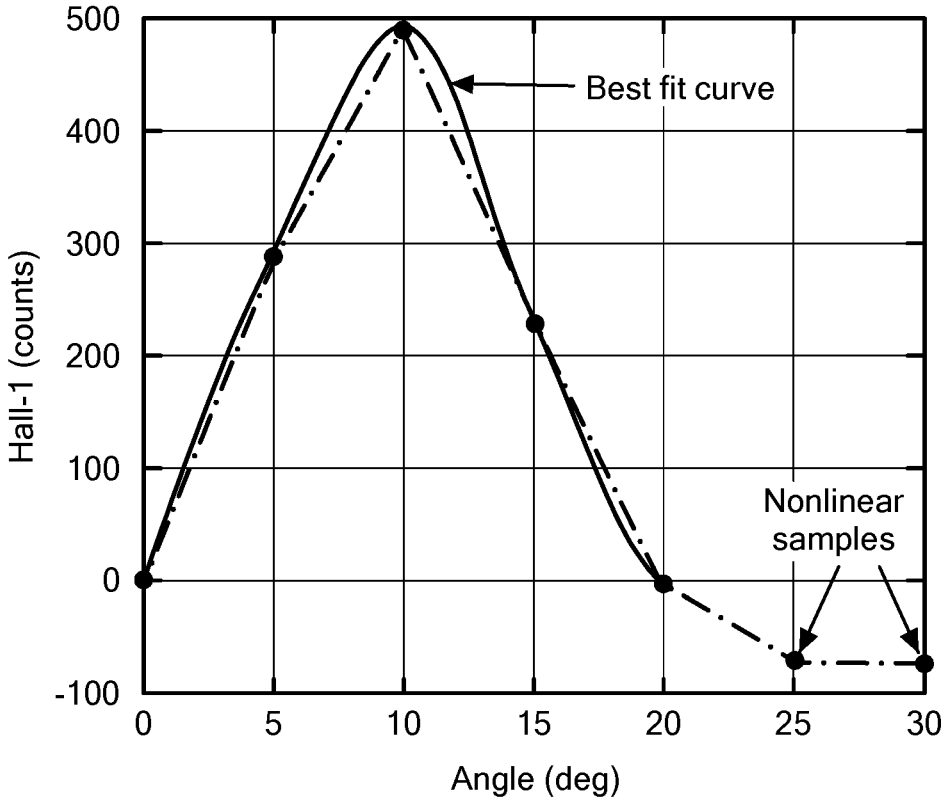
FIG. 8A is a plot of an example of a best fit curve, according to aspects of the disclosure.
Figure 8B:
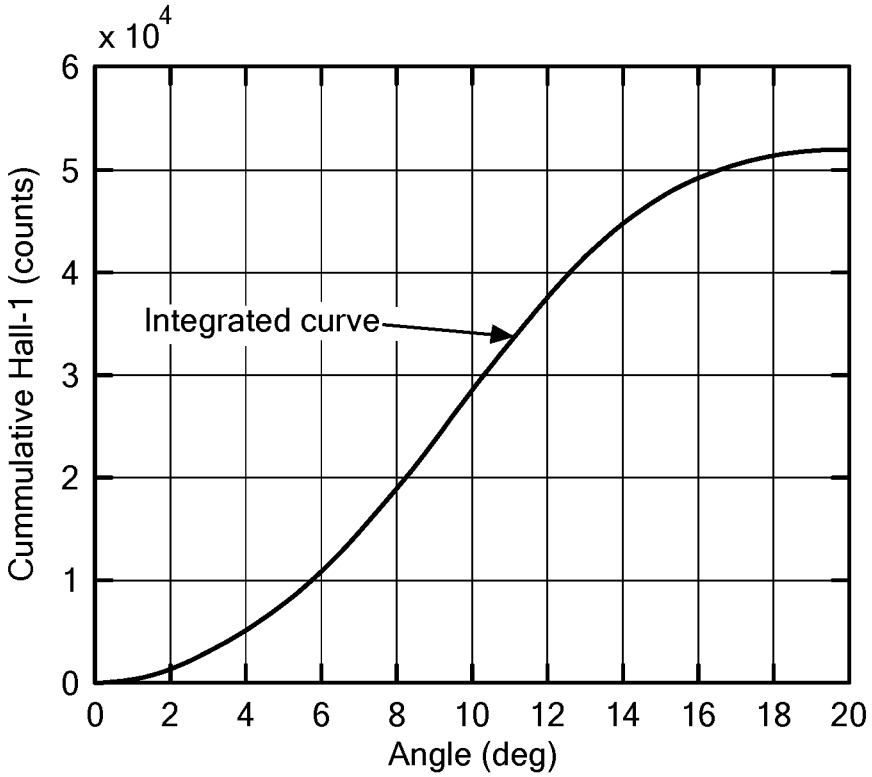
FIG. 8B is a plot of an example of an integrated curve, according to aspects of the disclosure.
Figure 8C:
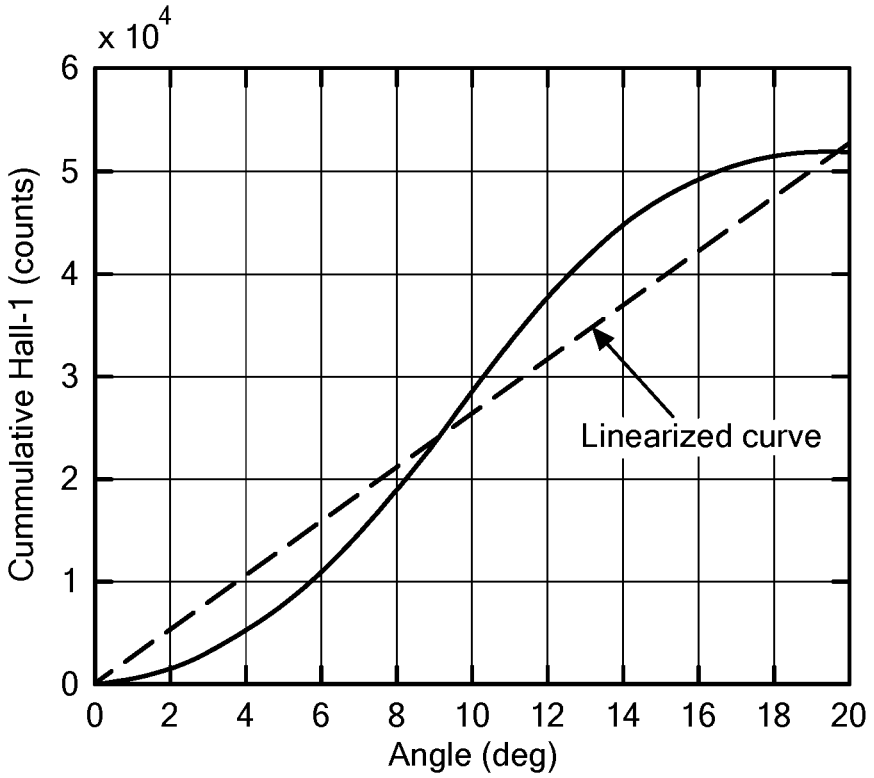
FIG. 8C is a plot of an example of a linearized curve, according to aspects of the disclosure.

At step 604, any offset that is present in the data set 310*a* is removed to produce a data set 310*a*' (not shown). At step 606, the data set 310*a*' is filtered with a low pass filter to produce a data set 310*a*" (not shown). At step 608, all non-linear data samples are removed from the data set 310*a*" to produce a data set 310*a*'". At step 610, a best fit curve is determined for the data set 310*a*'" (not shown). An example of the best fit curve is shown in FIG. 8A. At step 612, the best fit curve is integrated to negative slope from the best fit curve and produce an integrated curve. An example of the integrated curve is shown in FIG. 8B. At step 614, the integrated curve is linearized to produce a linearized curve. An example of the linearized curve is illustrated in FIG. 8C.

At step 616, a set of rotation degrees is determined based on the linearized curve. The set of rotation degrees may include a plurality of values, wherein each value identifies the angle between the fin 270*a* and the body 210 (of the projectile base 200) at a different time instant during the deployment of the fin 270*a* after the projectile 160 is launched.

At step 618, a set of radial fin displacement values is calculated based on the set of rotation degrees. Each value in the set of fin displacement values may identify the radial fin displacement of the fin 270*a* at a different time instant during the deployment of the fin 270*a*. Each value in the set of a fin displacement values may be calculated by multiplying a different one of the values in the set of rotation degrees by a scalar (e.g., a conversion factor).

Figure 7:
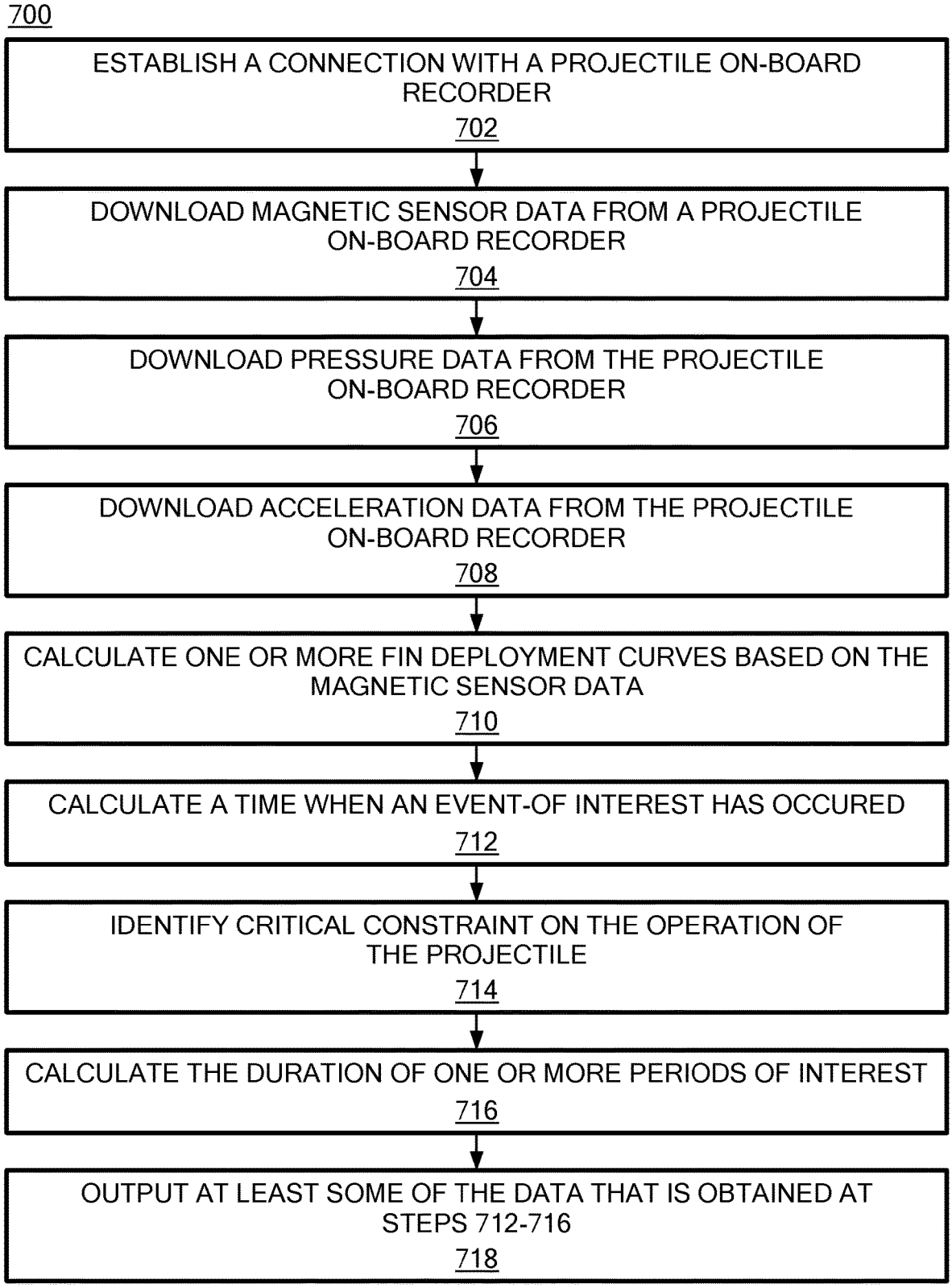
FIG. 7 is a flowchart of an example of a process, according to aspects of the disclosure.

FIG. 7 is a flowchart of an example of a process 700 for generating the plot 510, which is discussed above with respect to FIG. 5. According to the example of FIG. 7, the process 700 is performed by the workstation 400. However, alternative implementations are possible in which any of the steps in the process 700 is performed by the onboard data recorder 280 and/or any other computing device.

At step 702, the workstation 400 establishes a connection with the onboard data recorder. The connection may be established after the projectile 160 has been fired from the cannon 100 and subsequently retrieved. The present disclosure is not limited to any specific method for establishing the connection with the onboard data recorder. For example, in some implementations, the connection may be a wireless connection (e.g., a Bluetooth connection, a ZigBee connection, a WiFi connection, etc. Additionally, or alternatively, in some implementations, the connection may be a wired connection, such as a USB connection, a serial interface connection, a parallel interface connection, etc.

At step 704, the data sets 312 are downloaded onto the workstation 400 from the onboard data recorder 280. As noted above, each of the data sets 312 may include data that is generated by a different one of the magnetic sensors 242. At step 706, the data set 314 is downloaded onto the workstation 400 from the onboard data recorder 280. As noted above, the data set 314 may include data that is generated by the pressure sensor 252. At step 708, the data set 316 is downloaded onto the workstation 400 from the onboard data recorder 280. As noted above, the data set 316 may include data that is generated by the accelerometer 262. At step 710, the workstation 400 generates the fin deployment curves 512 based on the retrieved data sets 312. As noted above, each of the fin deployment curves 512 may be generated based on a different one of the data sets 312. In some implementations, each of the fin deployment curves 512 may be generated in accordance with the process 600, which is discussed with respect to FIG. 6.

At step 712, the workstation 400 identifies the time when an event of interest has occurred during the launch of the projectile based on at least one of the fin location data, the pressure data, and the acceleration data. For instance, the event of interest may include the projectile base 200 (and/or the projectile 160) reaching a particular location inside the cannon 100. More particularly, in some implementations, the event-of-interest may include the projectile base 200 (and/or the projectile 160) reaching the muzzle brake 130 of the cannon 100. In such implementations, the event-of-interest may be identified based on the data set 314, and it may be characterized by a drop (below a threshold) of the pressure that is incident on the projectile (as a result of propellant igniting). As can be readily appreciated, the drop in the pressure may be the result of the propellant gasses being partially released by the muzzle brake 130.

At step 714, the workstation 400 retrieves from memory an indication of an operational constraint. As noted above, the operational constraint may indicate the maximum distance by which the any of the fins of the projectile can extend before coming in contact with the barrel (and/or muzzle brake) of the cannon used to launch the projectile. At step 716, the workstation 400 calculated the duration of a one or more periods of interest. As noted above, each of the periods of interest may start when the event of interest has occurred, and end when a respective fin 270 has reached a predetermined radial displacement.

At step 718, at least some of the data obtained at steps 712-716 is output for presentation to a user. In some implementations, outputting at least some of the data obtained at steps 712-716 may include generating the plot 510 and displaying it on a display device. In some implementations, outputting at least some of the data obtained at steps 712-716 may include generating the plot 510 and transmitting it over a communications network to another device. In some implementations, outputting at least some of the data obtained at steps 712-716 may include displaying at least one of the fin deployment curves 512 or transmitting the fin deployment curve 512 to another device. Additionally, or alternatively, in some implementations, outputting at least some of the data obtained at steps 712-716 may include displaying an indication of the time when the event of interest has occurred (e.g., marker 530) or transmitting an indication of the time to another device. Additionally, or alternatively, in some implementations, outputting at least some of the data obtained at steps 712-716 may include displaying an indication of the duration of the periods of interest (e.g., one or more markers 540) or transmitting an indication of the duration to another device.

FIGS. 1-8C are provided as an example only. At least some of the steps discussed with respect to FIGS. 1-8C may be performed in parallel, in a different order, or altogether omitted. As used in this application, the word "exemplary" is used herein to mean serving as an example, instance, or illustration. Although FIGS. 1-8C are presented in the context of an artillery shell that is propelled using separate charge, it will be understood that the concepts and principles described throughout the disclosure can be applied to any suitable type of projectile, such as self-propelled projectiles, ground-to-ground missiles, anti-tank missiles, cruise missiles, etc. Any aspect or design described herein as "exemplary" is not necessarily to be construed as preferred or advantageous over other aspects or designs. Rather, use of the word exemplary is intended to present concepts in a concrete fashion.

According to the present disclosure, a projectile is considered launched as soon as the projectile begins moving (e.g., inside the barrel of a cannon, etc.). In this regard, when a projectile is launched from a cannon, after the launch, the projectile will move for some time inside the barrel of the cannon before it exits into the open. Similarly, according to the present disclosure, a projectile base is considered launched as soon as the projectile base (and/or a projectile which the projectile base is part of) begins moving (e.g., inside the barrel of a cannon, etc.). In this regard, when a projectile base is launched from a cannon, after the launch, the projectile base (and/or a projectile which the projectile base is part of) will move for some time inside the barrel of the cannon before it exits into the open. Although in the Example of FIGS. 1A-7, the onboard data recorder 280 is disposed inside the base of the projectile 160, alternative implementations are possible in which the on-board data recorder 280 is disposed elsewhere in the projectile 160. Although in the present example, the sensors 242, 252, and 262 are disposed in the projectile base 200, alternative implementations are possible in which any of the sensors 242, 252, and 262 is disposed in another portion of the body of the projectile 160. As used throughout the disclosure, and depending on context, the term "body" may refer to the body 210 of the projectile base 200 and/or another portion of the body of projectile 160 (e.g., main portion 180).

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

To the extent directional terms are used in the specification and claims (e.g., upper, lower, parallel, perpendicular, etc.), these terms are merely intended to assist in describing and claiming the invention and are not intended to limit the claims in any way. Such terms do not require exactness (e.g., exact perpendicularity or exact parallelism, etc.), but instead it is intended that normal tolerances and ranges apply. Similarly, unless explicitly stated otherwise, each numerical value and range should be interpreted as being approximate as if the word "about", "substantially" or "approximately" preceded the value of the value or range.

Moreover, the terms "system," "component," "module," "interface,", "model" or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Although the subject matter described herein may be described in the context of illustrative implementations to process one or more computing application features/operations for a computing application having user-interactive components the subject matter is not limited to these particular embodiments. Rather, the techniques described herein can be applied to any suitable type of user-interactive component execution management methods, systems, platforms, and/or apparatus.

While the exemplary embodiments have been described with respect to processes of circuits, including possible implementation as a single integrated circuit, a multi-chip module, a single card, or a multi-card circuit pack, the described embodiments are not so limited. As would be apparent to one skilled in the art, various functions of circuit elements may also be implemented as processing blocks in a software program. Such software may be employed in, for example, a digital signal processor, micro-controller, or general-purpose computer.

Some embodiments might be implemented in the form of methods and apparatuses for practicing those methods. Described embodiments might also be implemented in the form of program code embodied in tangible media, such as magnetic recording media, optical recording media, solid state memory, floppy diskettes, CD-ROMs, hard drives, or any other machine-readable storage medium, wherein, when the program code is loaded into and executed by a machine, such as a computer, the machine becomes an apparatus for practicing the claimed invention. Described embodiments might also be implemented in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the claimed invention. When implemented on a general-purpose processor, the program code segments combine with the processor to provide a unique device that operates analogously to specific logic circuits. Described embodiments might also be implemented in the form of a bitstream or other sequence of signal values electrically or optically transmitted through a medium, stored magnetic-field variations in a magnetic recording medium, etc., generated using a method and/or an apparatus of the claimed invention.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Also, for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

It will be further understood that various changes in the details, materials, and arrangements of the parts which have been described and illustrated in order to explain the nature of the claimed invention might be made by those skilled in the art without departing from the scope of the following claims.

The invention claimed is:

1. A projectile, comprising:

a body;

a fin having a magnet disposed thereon, the fin being coupled to the body, at least a portion of the fin being arranged to: (i) stay inside the body before the projectile is launched, and (ii) exit the body after the projectile is launched;

a magnetic sensor disposed within the body, the magnetic sensor being arranged to detect changes in a position of the magnet relative to the magnetic sensor while the fin is exiting the body; and a data recorder disposed within the body, the data recorder being operatively coupled to the magnetic sensor, wherein the data recorder is configured to use the magnetic sensor to collect data indicating a displacement of the fin relative to the body after the projectile is launched.

2. The projectile of claim 1, further comprising a data port disposed on the body, the data port being coupled to the data recorder.

3. The projectile of claim 1, wherein the data recorder includes a wireless interface for transferring data that is collected by the data recorder.

4. The projectile of claim 1, wherein the fin is coupled to the body via a mounting pin, and arranged to rotate around the mounting pin when the fin is exiting the body.

5. The projectile of claim 1, further comprising a pressure sensor disposed in the body, the pressure sensor being operatively coupled to the data recorder.

6. The projectile of claim 1, further comprising an accelerometer disposed in the body, the accelerometer being operatively coupled to the data recorder.

7. The projectile of claim 1, wherein the magnetic sensor is disposed in a portion of the body that is formed of a non-ferrous material.

8. The projectile of claim 1, further comprising a switch that is activated when the projectile is fired, the switch including one of an accelerometer switch, a g-switch device, and a pressure-activated switch, wherein the data recorder is configured to collect data when the switch is switched on.

9. The projectile of claim 1, wherein the magnet is disposed at a location on the fin, such that the magnet is situated inside the body when the fin is in a stowed position, and the magnet is situated outside the body when the fin is situated outside of the body when the fin is in an extended position.

10. The projectile of claim 1, wherein the data recorder includes a processor, a memory, and an enclosure that is arranged to house the processor and the memory, the processor and memory being encapsulated in an encapsulating material that is disposed inside the enclosure.

11. A projectile, comprising:

a body;

a plurality of fins coupled to the body;

a plurality of magnets, each of the magnets being disposed on a different respective one of the plurality of fins, wherein each of the magnets is disposed inside the body when the magnet's respective fin is in a stowed position, and each of the magnets the magnet is situated outside the body when the magnet's respective fin is in an extended position;

a plurality of magnetic sensors disposed inside the body, each of the magnetic sensors being disposed adjacent to a different one of the plurality of fins; and a data recorder disposed inside the body, the data recorder being operatively coupled to each of the plurality of magnetic sensors, wherein the data recorder is configured to collect data indicating a respective displacement of each of the plurality of fins after the projectile is launched.

12. The projectile of claim 11, wherein the data recorder includes a wireless interface for transferring data that is collected by the data recorder.

13. The projectile of claim 11, wherein each of the plurality fins is coupled to the body via a respective mounting pin, and each of the plurality of fins is arranged to rotate about the fin's respective mounting pin when the projectile is launched.

14. The projectile of claim 11, further comprising a pressure sensor disposed in the body, the pressure sensor being operatively coupled to the data recorder.

15. The projectile of claim 1, further comprising a accelerometer disposed in the body, the accelerometer being operatively coupled to the data recorder.

16. A method for analyzing an operation of a fin-stabilized projectile, the method comprising:

receiving a position data set that is collected by a data recorder disposed inside a fin-stabilized projectile, the data set indicating a position of a fin of the projectile at different time instants;

receiving a pressure data set indicating a pressure experienced by the projectile at different time instants;

identifying an event of interest based on the pressure data set; and generating a deployment curve for the fin, the deployment curve identifying the position of the fin at different time instants during a launch of the fin-stabilized projectile.

17. The method of claim 16, further comprising identifying a time when the projectile has reached a muzzle brake of a barrel that is used to launch the projectile.

18. The method of claim 16, wherein the deployment curve identifies radial displacement of the fin relative to a body of the projectile at different time instants.

19. The method of claim 16, further comprising displaying a plot of the fin deployment timeline.

20. The method of claim 16, wherein the plot identifies a time when the projectile has reached a muzzle brake of a barrel that is used to launch the projectile.

* * * * *